US006314696B2

(12) United States Patent
Fust, III

(10) Patent No.: US 6,314,696 B2
(45) **Date of Patent: *Nov. 13, 2001**

(54) REINFORCED CONCRETE WALLS HAVING EXPOSED ATTACHMENT STUDS

(76) Inventor: John W. Fust, III, 333 Lake Rd., Stuarts Draft, VA (US) 24477

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,796

(22) Filed: Mar. 25, 1999

(51) Int. Cl.[7] ..... E04B 2/40

(52) U.S. Cl. ..... 52/422; 52/309.8; 52/376; 52/426; 52/435; 52/729.2; 52/742.14

(58) Field of Search ..... 52/309.8, 309.15, 52/309.17, 376, 422, 424, 425, 426, 432, 435, 729.2, 729.3, 729.4, 729.5, 742.14, 745.09, 777, 778, 779

(56) References Cited

U.S. PATENT DOCUMENTS

| | | | | |
|---|---|---|---|---|
| 1,327,292 | * | 1/1920 | Raymond | 52/778 X |
| 2,387,432 | * | 10/1945 | Du Laney | 52/376 |
| 3,221,467 | * | 12/1965 | Henkels | 52/729.2 X |
| 3,258,889 | | 7/1966 | Butcher . | |
| 3,638,382 | * | 2/1972 | Merrill | 52/376 X |
| 3,992,844 | | 11/1976 | Gretter . | |
| 4,191,000 | * | 3/1980 | Henderson | 52/729.4 |
| 4,223,501 | | 9/1980 | DeLozier . | |
| 4,638,619 | * | 1/1987 | Fischetti | 52/729.4 |
| 4,706,429 | | 11/1987 | Young . | |
| 4,730,422 | | 3/1988 | Young . | |
| 4,730,431 | * | 3/1988 | Ericsson | 52/376 X |
| 4,748,786 | * | 6/1988 | Hannah | 52/729.2 X |
| 4,751,803 | | 6/1988 | Zimmerman . | |
| 4,860,515 | * | 8/1989 | Browning, Jr. | 52/422 X |
| 4,879,855 | | 11/1989 | Berrenberg . | |
| 4,885,888 | | 12/1989 | Young . | |
| 4,967,528 | * | 11/1990 | Doran | 52/426 X |
| 5,003,742 | * | 4/1991 | Dettbarn | 52/309.8 X |
| 5,459,971 | | 10/1995 | Sparkman . | |
| 5,568,710 | | 10/1996 | Smith et al. . | |
| 5,657,600 | | 8/1997 | Mensen . | |
| 5,819,489 | * | 10/1998 | McKinney | 52/426 X |

* cited by examiner

*Primary Examiner*—Carl D. Friedman
*Assistant Examiner*—Kevin D. Wilkens
(74) *Attorney, Agent, or Firm*—Armstrong, Westerman, Hattori, McLeland & Naughton, LLP

(57) ABSTRACT

A spacing web frame assembly for a molded construction form for use in forming a reinforced concrete wall including a pair of inner and outer vertically-oriented attachment studs and a reinforcing wire truss assembly having ends attached to the inner and outer attachment studs to provide a predetermined spacing distance between the inner and outer attachment studs. The studs are visible to the outside when the molded foam panels are attached thereto and the concrete is then added to form the walls. The studs may be formed of either wood or metal, depending upon the type of attachment fasteners desired to be driven into the studs.

30 Claims, 7 Drawing Sheets

REINFORCED CONCRETE WALLS HAVING EXPOSED ATTACHMENT STUDS

BACKGROUND OF THE INVENTION

1. Field of the Invention

The present invention relates to the field of building materials and, more specifically, to the field of non-removable insulating concrete forms.

2. Description of the Related Art

Reinforced concrete walls constructed using foam forming systems are well known in the building construction field, and many utilize "Insulating Concrete Forms" (ICFs). These systems all comprise an inner and outer panel spaced a specific distance apart, thus forming a void between panels into which concrete is placed. The differences between them center mainly around the "web", whose function is to provide the specific parallel spacing desired between the foam panels; to hold the panels together; to resist the force of concrete during placement; and further to provide a system for attaching finishing materials to the wall.

U.S. Pat. No. 4,879,855 to Berrenberg discloses an attachment and reinforcement member for molded construction forms utilizing a web of expanded steel with flanges at right angles to the central web. U.S. Pat. No. 5,657,600 to Menson and U.S. Pat. No. 5,459,971 to Sparkman both show webs of polymeric material sharing a similar function as explained above. All of these prior art systems provide for the web to be embedded into the foam panels during manufacture. Each system provides for a specific form unit to be created, although there is no standard size, and most units are 48"L×16"H×11"D. The void between panels may also vary to form a concrete wall 6" to 8" thick.

All prior art systems which have been previously used by the inventor of the present invention provide such forms for the concrete wall. However, it was during the attachment of finishing materials to the wall that many inadequacies became apparent, as discussed below.

1. Metal webs preclude the use of nails for attaching any finishing materials to the wall. Thin sheet metal fails to hold nails and, therefore, screws must be used. Siding materials such as wood and vinyl, however, are most preferably nailed. Fasteners used for vinyl are hidden, therefore, screws could be used but getting tradespeople to accept screws is problematic. Screwguns, cords and batteries cannot replace the simplicity of a hammer. Wood sidings usually require that fasteners remain visible and, aesthetically speaking, screws would never be acceptable, considering that their use involves more labor and many tools. In order to use such finishes the entire building must be furred with wood strips made for the purpose, which is an additional step that is costly in labor and material and is inadequate in that a thin strip of untreated wood could hardly be expected to last long enough to provide the continuous holding power needed to support high quality siding designed and finished to last 50 years. If the attachment member is not integrated into the forming system, so as to save steps, and itself engineered to last as long as the walls are expected to last, then such a method should be abandoned.

A main advantage of ICF construction is that many traditional phases of construction are incorporated into a single step, i.e., foundation, insulation, framing, sheathing, and air barriers, that to build with the prior art ICF construction systems that do not allow tradespeople to use their choice of fastener is to invite their disapproval and ultimately slows the acceptance of ICF construction in general.

2. It has been found that the attachment flange in the prior art ICF construction usually did not extend fully from the top to the bottom of the form unit, the unit being 16" tall. The flanges stopped 1" from both the top and bottom, thereby leaving a space of 2" where nothing could be attached. Although not all the prior art form units have this defect to this degree, none have one continuous attachment member extending from floor to ceiling, as provided for in the present invention.
3. Most molded units are manufactured in a central location which mandates long distance shipping costs to transport material around the country. In addition, block type forms are large and the space that will ultimately be filled with concrete takes up space, thereby limiting the amount of units that can be shipped per truck. This affects the total wall square footage that can be installed per truckload shipped.
4. The tendency of molded stackable units to float during the placement of concrete has been well documented and witnessed by most construction professionals with experience in the field. Wiring, taping, or otherwise fastening subsequent courses of ICF units to one another solves this problem although, in doing so, adds a step to the process. Floating occurs when concrete rapidly fills the void and the velocity of the rising material causes the very lightweight units to float upward. Once units float apart, it is very difficult, if not impossible, to properly position them again, which is a condition that can seriously affect the overall quality of the installation.

SUMMARY OF THE INVENTION

The prior art has been primarily the work of persons with backgrounds in the construction of walls built with concrete masonry units, hence, the propensity of block type systems. These prior art systems focus primarily upon the formation of a concrete wall which is the aspect that provides the building with its structural integrity. The present invention departs from this focus by introducing the concept of a lightweight structural frame that is primarily concerned with the attachment of materials to the wall after the concrete has been poured.

The present invention is the work of a carpenter who is familiar with the needs of those who follow the foundation installation. Present day carpentry makes use of dimensional lumber as its primary building component. There are various lengths and widths of material with which to work, and except for "the plans", there are no set methods that must be followed to achieve the desired end. In this light, carpenters have much freedom and utilize very simple building components. These simple components, i.e., "boards", can be cut in very complex ways and used to create very unique and complex structures.

The present invention is very similar to the "board". It is, in fact, a hollow board. It is to wall studs what engineered wood I-joists are to dimensional lumberjoists. It can be made to various lengths and widths, installed vertically or horizontally for walls, and used as joists for floors. It is a new primary framing component. To enhance its simplicity and adaptability to all the variety of construction needs, the present invention has two main components in its assembly. The first is a wire reinforcement truss that can be made of various gauges of wire where the larger the gauge, the stronger the truss. The second component is the attachment stud which can also be made of various materials such as wood, metal, and polymeric composites, and in various sizes and shapes.

The present invention is then used to frame the shape of the desired structure with few limitations. It provides the framework for rigid foam panels that are shaped specifically to fit the framework. The panels provide foam-to-foam closure on the interior of both inner and outer wall panels. The present invention is also positioned to accept a wide variety ofpolymeric foam, and may utilize technological advancements in foam or other insulative rigid panels.

One embodiment of the present invention provides wooden studs held a specific distance apart by a galvanized welded wire reinforcement truss. Each stud is grooved in its center a specific depth and width to receive the preformed wire truss which is forced into the groove. Prior to insertion, an adhesive is applied into the groove. After insertion, mechanical fasteners are installed at precise points along the stud so as to preclude the withdrawal of the wire until the adhesive has had sufficient time to set and permanently bond the wire truss to the wooden stud. The present invention also provides for the use of a metallic stud for commercial construction where the use of screws is preferred over the use of nails.

The wooden stud provides a strong purchase for both nails and screws and allows the trades to use their choice of fastener. The present invention preferably uses only #1 grade pressure treated lumber for the studs and consequently should have no problems with premature rot or insect damage.

The attachment studs are completely visible. Unlike some prior art form units whose attachment flanges are hidden beneath a layer of foam, this makes it even easier to attach finish materials, thus speeding that phase of construction.

The present invention seeks to satisfy all the necessary trades with simple, easy to use tools and techniques. For example, electricians will find the use of a hot knife to slice a channel into the foam much easier than drilling through studs for the wire runs.

BRIEF DESCRIPTION OF THE DRAWINGS

FIG. 2A shows the spacing web frame assembly including a wooden attachment stud, and FIG. 2B shows a top view of the stud and the open groove.

DETAILED DESCRIPTION OF THE PREFERRED EMBODIMENTS

Figure 1:
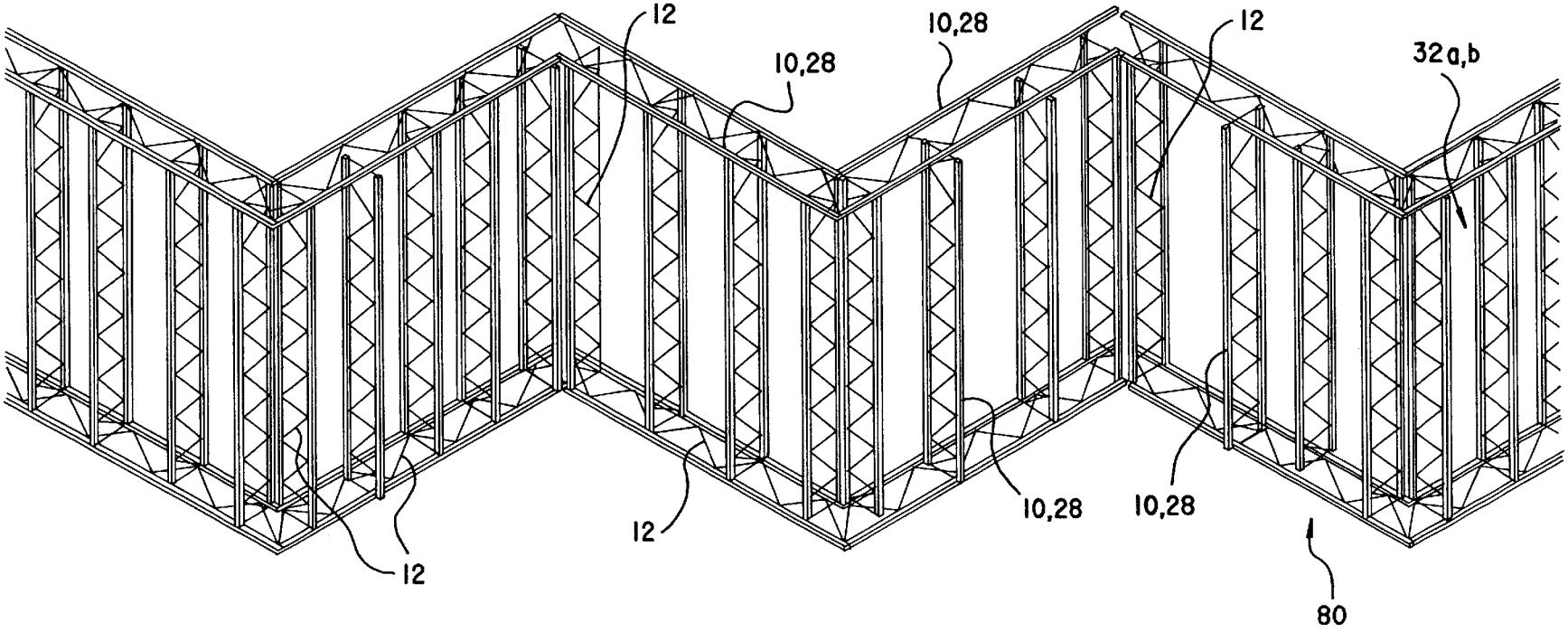
FIG. 1 is a perspective view of the reinforced concrete wall of the present invention, absent the foam panels or concrete.

FIG. 1 shows a perspective view of the reinforced concrete wall 80 of the present invention, absent the foam panels 14 or the concrete 50 which is poured into the reinforced concrete wall after final assembly is completed. FIG. 1 clearly shows attachment studs 10 or 28 and reinforcing wire truss assembly 12 attached to each stud. FIG. 1 shows how the reinforcing wire truss assembly 12 may be used to separate studs 10, 28, oriented either vertically or horizontally, along the length of the walls.

Figure 2C:
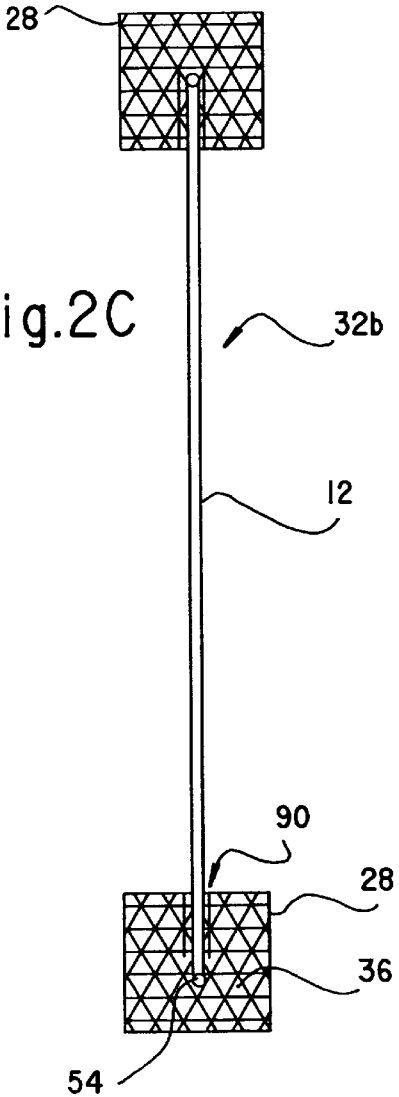
FIG. 2C is a top view of a second embodiment of the present invention, including a metallic attachment stud.
Figure 2B:
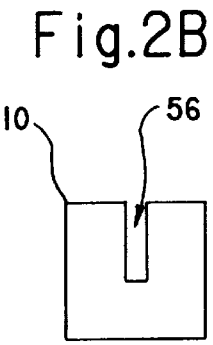
FIGS. 2A and 2B show a top view of a first exemplary embodiment of the present invention, where
Figure 2A:
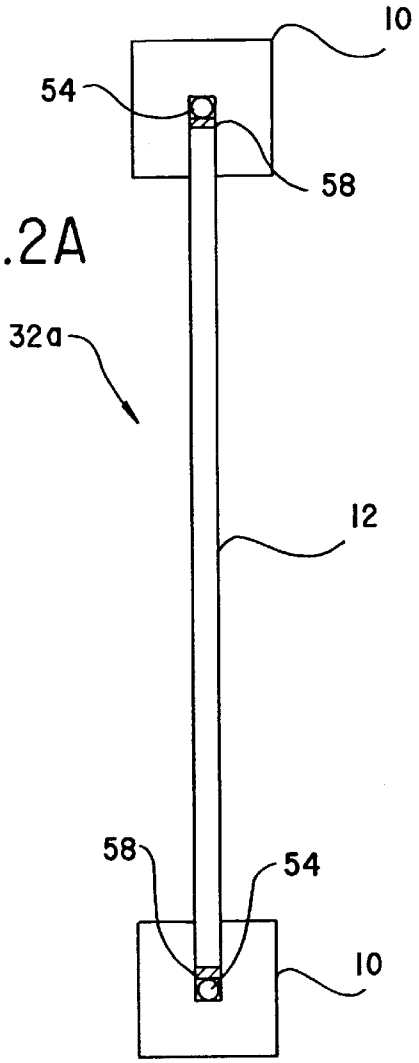
Figure 3:
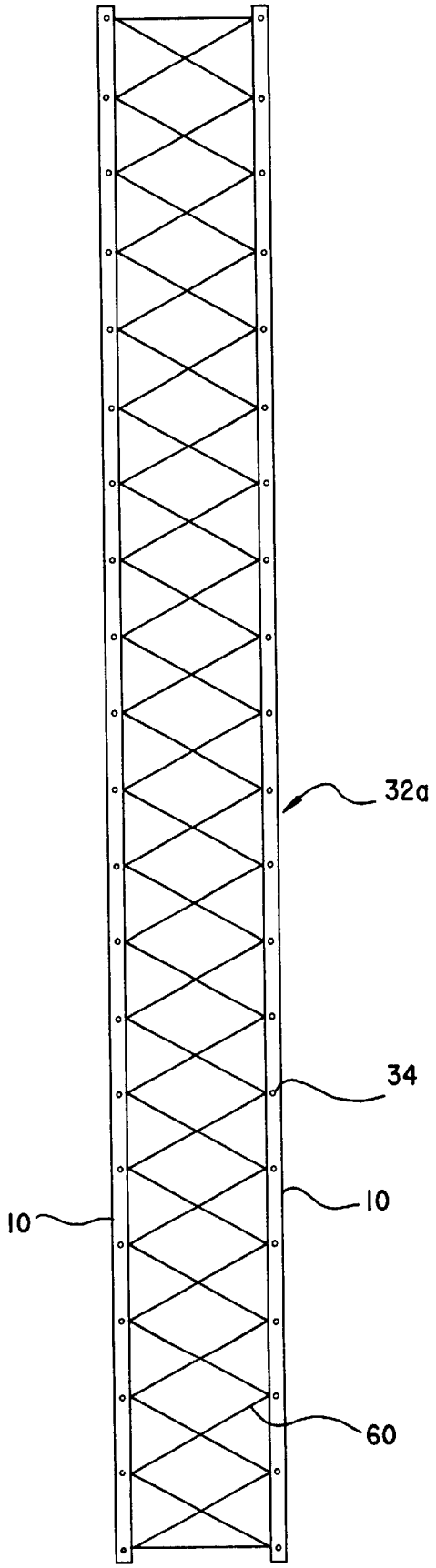
FIG. 3 is a plan view of a third embodiment of the present invention, specifically illustrating the spacing web frame assembly utilizing wooden attachment studs.

FIGS. 2A and B shows a top view of the spacing web frame assembly 32*a* for the wall of a first exemplary embodiment of the present invention, in which a pair of inner and outer vertically-mounted wooden attachment studs 10 are spaced apart by a reinforcing wire truss assembly 12 having ends 54 fitting snugly within a groove 56 formed in the center of each of the studs 10. An adhesive 58 is applied into the groove 56 to hold the end 54 of the reinforcing wire truss assembly 12 in the groove. A plurality of mechanical fasteners 34, such as wood screws, are installed at predetermined points along each attachment stud 10 to form the spacing web frame assembly 32*a*, as shown in FIG. 3, in order to prevent the withdrawal of the ends of the reinforcing wire truss assembly 12 prior to setting of the adhesive 58. If desired, after setting of the adhesive 58, the mechanical fasteners 34 may be removed.

Figure 4:
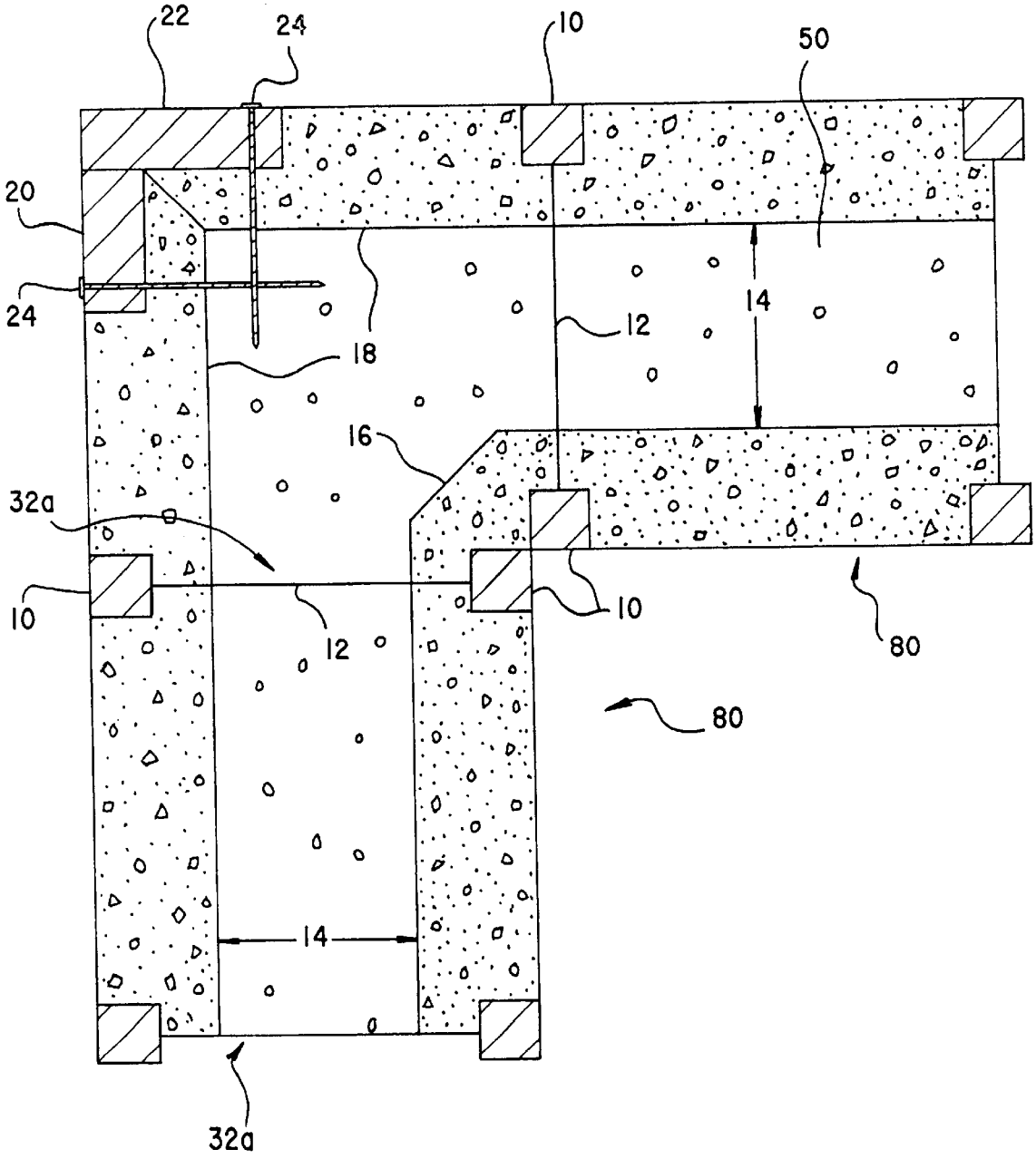
FIG. 4 shows a top cross-sectional view of the reinforced concrete wall of the present invention illustrating a 90° corner construction.
Figure 6:
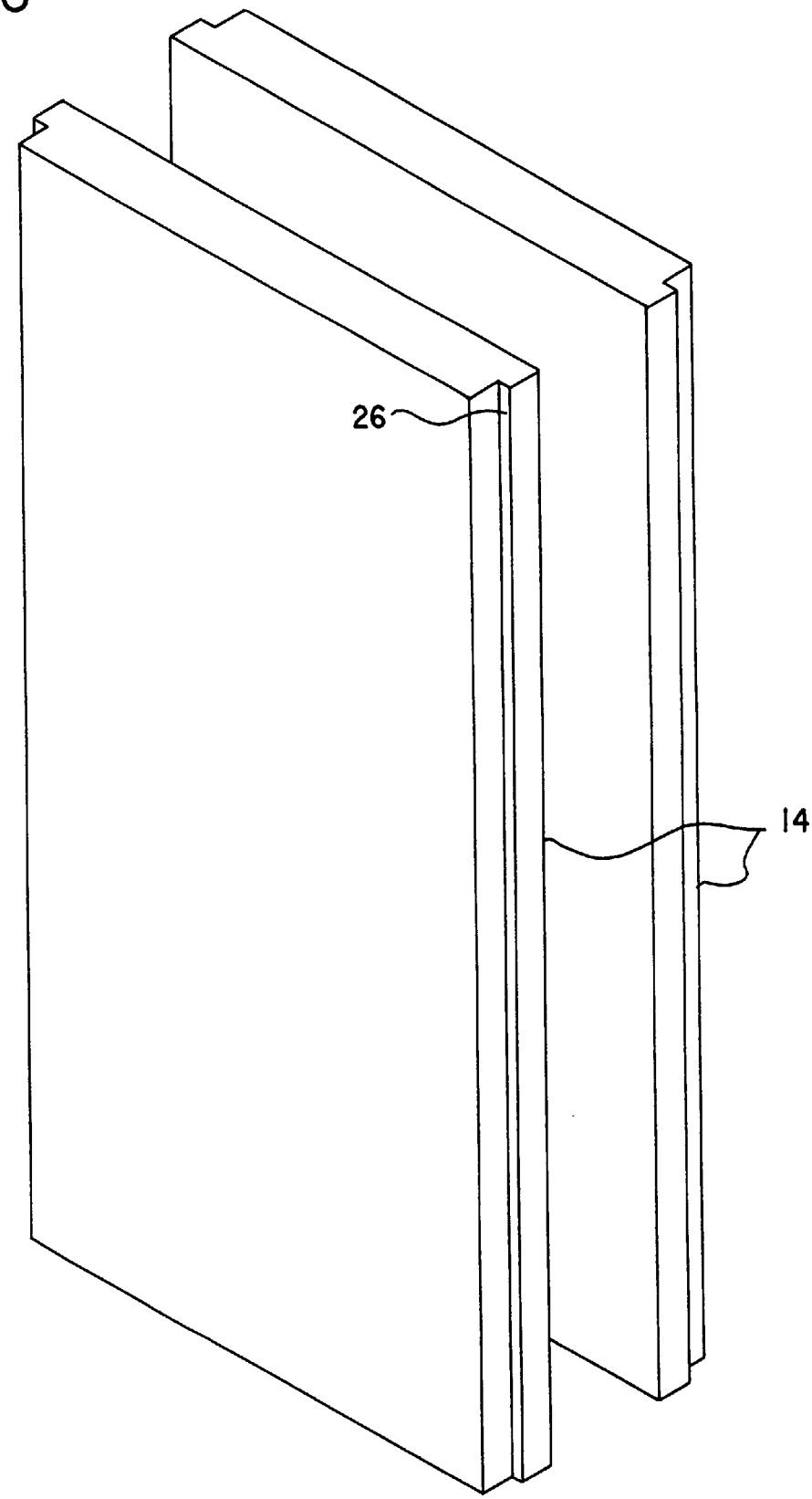
FIG. 6 is a perspective view of the molded rectangular panels utilized in the present invention.

A pair of molded rectangular panels 14 are then placed between each of the spacing web frame assemblies 32*a*, as shown in FIG. 4. Each of the panels 14 is preferably made of foam and has rectangular recesses 26 on a pair of opposite ends, as shown in FIG. 6, although the recesses need not be rectangular in shape. The panels 14 are placed such that the wooden attachment studs 10 are contained in a combination of vertically-oriented recesses, as shown in FIG. 4, where the studs 10 are visible from the exterior of both sides of the wall 80.

FIG. 4 further illustrates how individual components may be assembled to form a corner. By repeating the pattern of one spacing web frame assembly 32*a* and a pair of molded panels 14, a wall of unlimited length and any number of corners may be constructed. Wooden corner studs 20 and 22 are fastened to each other with conventional fasteners, shown here as spikes 24, and held in proper orientation with temporary bracing (not shown). The spikes 24 are set into freshly poured concrete 50 and, upon hardening, the corner studs 20, 22 are held permanently in place. Interior foam corner component 16 is shaped to fit the spacing web frame assemblies oriented at right angles to one another and is used to insure a continuous foam interior wall plane. The outer corner foam rectangular panels 18 are formed by appropriately shaping the standard molded rectangular panels 14 to hold the corner studs 20, 22, as shown in FIG. 4.

Figure 5:
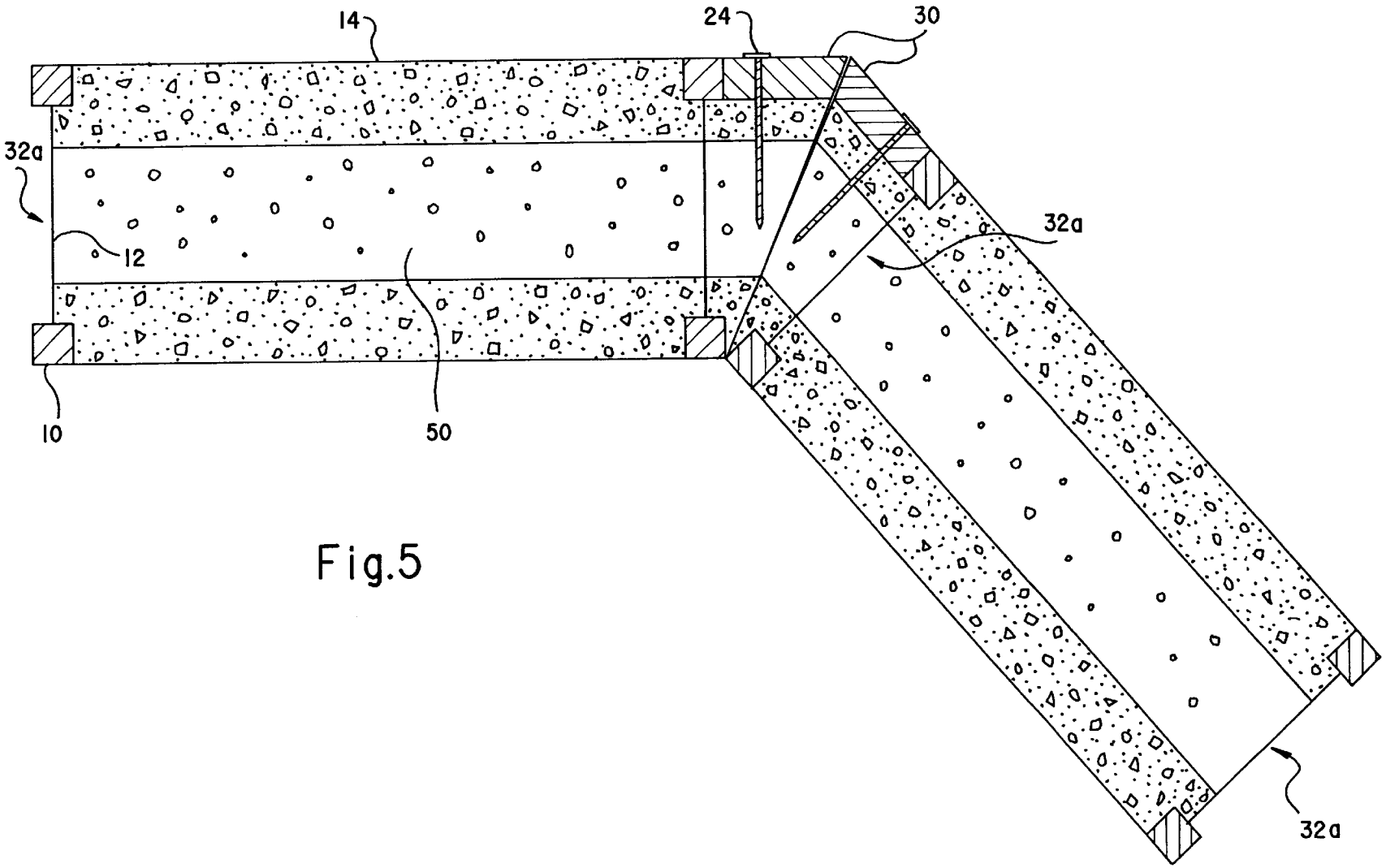
FIG. 5 is a top cross-sectional view of the reinforced concrete wall of the present invention illustrating a corner construction in which the angle is greater than 90°.

FIG. 5 shows the construction of a corner having an angle greater than 90°, where the wooden component 30 forming the corner may be easily shaped.

FIG. 2C shows a second embodiment of the present invention in which all the components are the same as in the first embodiment except for the composition of the attachment stud 28 and the method of attaching the reinforcing wire truss assembly 12 to the attachment stud 28 to form a spacing web frame assembly 32*b*.

As shown in FIG. 2C, the stud 28 is formed of metal, such as steel. Sheet metal is processed on a continuous roll former (not shown) which heats the sheet metal, thereby permitting it to be bent to form a stud having a channel 90 formed in the center, the channel 90 preferably having a width greater than the diameter of an end 54 of the reinforcing wire truss assembly 12. The end 54 of the reinforcing wire truss assembly 12 is inserted loosely into the channel 90. The space between the end 54 of the reinforcing wire truss assembly 12 and the metallic attachment stud 28 is injected with a dense foam component 36 to insure that there is no metal-to-metal contact between the end of the reinforcing wire truss assembly 12 and the metallic attachment stud 28.

Figure 7:
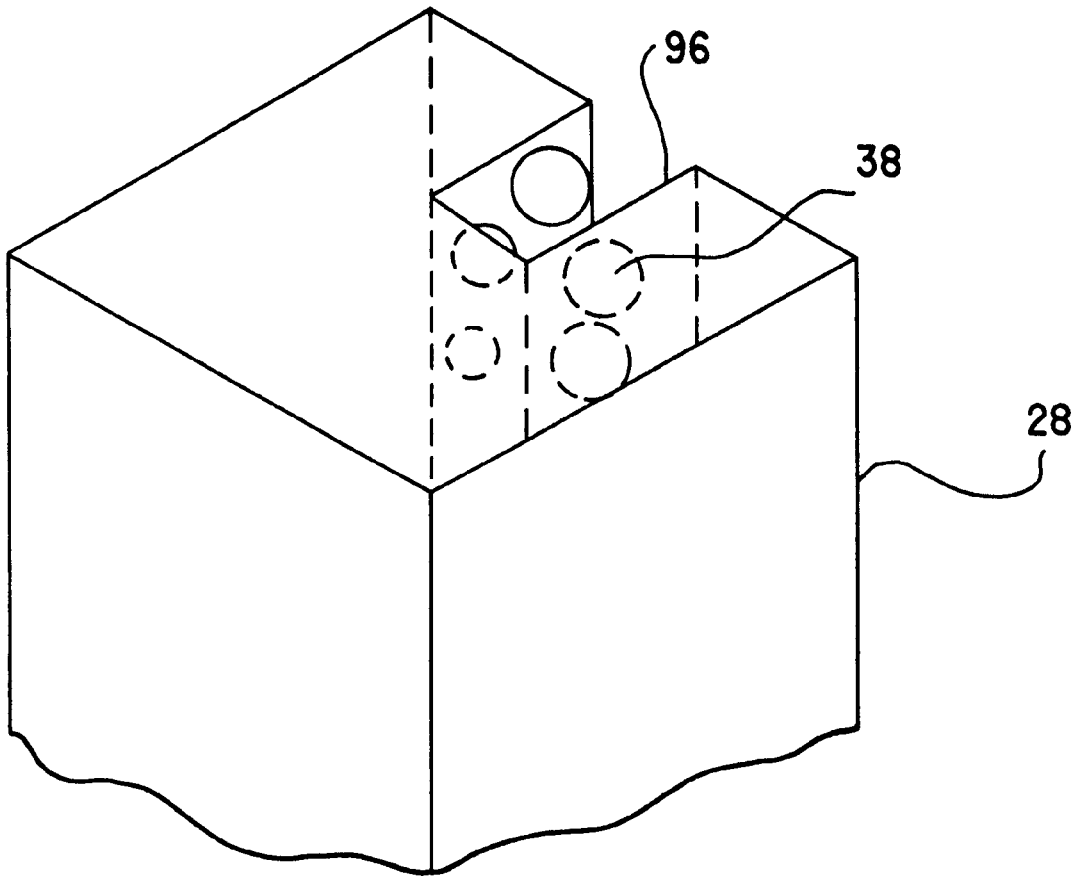
FIG. 7 is a partial phantom view of the metallic attachment stud of the present invention.

FIG. 7 shows that the interior flange 96 of the metallic attachment stud 28 may contain a plurality of perforations 38 for allowing free flow of the foam into the interior of the metallic attachment stud 28, thereby inhibiting heat conduction between the reinforcing wire truss assembly 12 and the metallic attachment stud 28, resulting in improved insulation qualities between the inner and outer surfaces of wall 80.

The present invention can be fabricated on site because its construction utilizes components that can be purchased "off the shelf". It is preferable to use standard two pound density foam (EPS) that is readily available. The wood and wire can be acquired at most any building supply store. This system may be shipped totally disassembled, thereby increasing the amount of material that can be transported to the job per truck/trip. It is estimated that twice the amount of finished wall material, as compared to molded block systems, may be carried on the same size truck.

The present invention solves the floating problem discussed above because of the nature of its installation. The present invention is generally installed vertically rather than in successive horizontal courses. In setting a unit whose standard size is 2'×10', twenty square feet of wall may be effectively set with no horizontal seams to float apart. This solves the floating problem without adding steps to the process. The system can also be installed horizontally and, in some applications, this would be preferable, but because of the method used to brace the forms plumb and straight, the floating tendency is eliminated even when installed horizontally.

The present invention further has no arbitrary limitation with regards to attachment stud spacing. Prior art pre-molded units with integral webs have attachment flanges whose spacing is determined prior to manufacture and cannot be altered. The fact that the present invention stud spacing can be altered according to need or desire allows for many more fastening options. For example, in the kitchen of homes, one finds wall cabinets often containing heavy dishes hanging from the wall unsupported from below. The system of the present invention could choose a stud spacing that could easily conform to the needs for fastening dictated by the cabinet design and provide solid fastening precisely where one needs it to be. When installed with a vertical orientation, this system provides continuous bearing from foundation to roof. Because the spacing web frame assembly 32*a*, 32*b* is a load bearing member, this system also allows the permanent floor system to be installed prior to pouring concrete, which is usually delivered through a hose/pump. Because the floor is in place, this allows for a very safe and easy placement of the concrete. No known prior art system can claim any weight bearing prior to the placement of concrete.

In addition, the width of the wire reinforcement may be increased to allow for thicker walls where necessary. The thickness of foam could be increased or the thickness of the concrete increased, or both, where needs may arise. Below ground walls, for example, may require thicker concrete and less foam but when the wall rises above ground more insulation and less concrete may be desirable. The present invention allows for many variations in design requirements that known prior art systems do not.

The reinforcing wire truss assembly 12 is readily available in widths from 4" to 20" and is produced for the reinforcement of traditional concrete masonry units. A width of 10" to 12" is preferable for exterior wall systems. It is preferably galvanized to resist corrosion and comes in a configuration that permits ease of assembly. The reinforcing wire truss assembly 12 preferably consists of preferably four separate wires, two of which are in a specific spaced parallel relationship forming the ends 54 fitting in either the groove 56 in wooden attachment stud 10 or in channel 90 of metal attachment stud 28. The third and fourth wires 60 oscillate and criss-cross back and forth between the two parallel wires. Each of the third and fourth wires 60 is welded to one of the parallel wires every 16", and is welded to the other of the parallel wires every 16" in a staggered 8" relation to the first wire. This construction forms a wire truss assembly and is designed to resist lateral forces imposed against a typical concrete block wall. In the embodiment shown in FIG. 1, only one oscillating wire 60 connects the parallel wires forming the ends 54 of the reinforcing wire truss assembly.

During pouring of concrete, the wire offers no impediment to the flow of the material, the significant factor here being that the possibility of voids and honeycombing of the concrete are greatly reduced, thereby increasing the strength and consolidation of the concrete.

The present invention is not limited to any specific type of foam for forming the molded rectangular panels. EPS, XPS and urethane foams could all be used, and in any desired density. One and two pound density EPS have both been utilized with good results. The higher density foam yields higher R factors which could impact the expected energy savings. Two pound density EPS foam has an R rating of approximately 4.5 per inch, which in the standard application of two 3' thick panels achieves an R-27 wall.

The most important aspect that construction materials must offer, if they are ever to gain wide acceptance, is adaptability to the needs and desires of the construction professionals using them. Manufacturers make arbitrary decisions about the size and composition of a building unit, as they must to be able to gain efficiency and to mass produce. Such decisions can easily become limitations that cause impositions on design. Builders desire more freedom to use building materials in innovative and creative ways so as to distinguish their projects from those of their peers. The lightweight semi-structural hollow wall frame of the present invention, including either the wooden studded spacing web frame assembly 32*a* or the metallic studded spacing web frame assembly 32*b*, offers just that.

I claim:

1. A reinforced concrete wall, comprising:

a plurality of molded rectangular members having inner and outer surfaces and a vertically-oriented recess at the outer corner of each rectangular member;

a plurality of spacing web frame assemblies attached at either end to the vertical edges of the outer surface of each rectangular member, each spacing web frame assembly including a pair of inner and outer vertically-oriented attachment studs, and a reinforcing assembly having ends attached to the inner and outer attachment studs, the inner and outer attachment studs fitting snugly into the space formed by a combination of two adjoining recesses to permit an outer surface of each stud to remain visible and to provide a predetermined spacing distance between the inner and outer attachment studs; and concrete contained between the plurality of molded rectangular members.

2. The reinforced concrete wall as recited in claim 1, wherein each of the attachment studs includes a wooden member having a groove to receive one end of the reinforcing assembly.

3. The reinforced concrete wall as recited on claim 1, wherein each of the attachment studs includes a metallic member shaped to receive one end of the reinforcing assembly.

4. The reinforced concrete wall as recited in claim 1, wherein the molded rectangular members consist of foam.

5. The reinforced concrete wall as recited in claim 1, wherein the reinforcing assembly comprises a reinforcing wire truss assembly including a plurality of strands of wire.

6. The reinforced concrete wall as recited in claim 1, wherein said combination of two adjoining recesses forms a rectangular recess open on one side.

7. The reinforced concrete wall as recited in claim 1, wherein each of the attachment studs includes a polymeric composite member shaped to receive one end of the reinforcing assembly.

8. A spacing web frame assembly for a molded construction form for use in forming reinforced concrete walls, comprising:

a pair of inner and outer vertically-oriented attachment studs;

a reinforcing wire truss assembly having ends attached to the inner and outer attachment studs to provide a predetermined spacing distance between the inner and outer attachment studs, each of the attachment studs including a wooden member having a groove to receive one end of the reinforcing wire truss assembly;

adhesive applied to the grooves; and a plurality of mechanical fasteners installed at predetermined points along each one of the wooden attachment studs securing the reinforcing wire truss assembly in the grooves in conjunction with the adhesive.

9. The spacing web frame assembly as recited in claim 8, wherein said reinforcing wire truss assembly includes at least three wires, two of the wires forming the ends of the reinforcing wire truss assembly and at least one remaining wire is shaped in an oscillating, back-and-forth arrangement between the two ends.

10. The spacing web frame assembly as recited in claim 9, wherein said reinforcing wire truss assembly includes four galvanized wires, two of which are shaped in an oscillating arrangement criss-crossing back-and-forth between the two ends.

11. A spacing web frame assembly for a molded construction form for use in forming reinforced concrete walls, comprising:

a pair of inner and outer vertically-oriented attachment studs; and a reinforcing wire truss assembly having ends attached to the inner and outer attachment studs to provide a predetermined spacing distance between the inner and outer attachment studs, wherein each of the attachment studs includes a metallic member shaped to receive one end of the reinforcing wire truss assembly, and wherein said reinforcing wire truss assembly includes at least three wires, two of the wires forming the ends of the reinforcing wire truss assembly and at least one remaining wire is shaped in an oscillating, back-and-forth arrangement between the two ends.

12. The spacing web frame assembly as recited in claim 11, wherein said reinforcing wire truss assembly includes four wires, two of which are shaped in an oscillating arrangement criss-crossing back-and-forth between the two ends.

13. A spacing web frame assembly for a molded construction form for use in forming reinforced concrete walls, comprising:

a pair of inner and outer vertically-oriented attachment studs;

a reinforcing wire truss assembly having ends attached to the inner and outer attachment studs to provide a predetermined spacing distance between the inner and outer attachment studs, each of the attachments studs including a polymeric composite member having a channel to receive one end of the reinforcing wire truss assembly; and a securing means for securing the reinforcing wire truss assembly in the channel, and wherein said reinforcing wire truss assembly includes at least three wires, two of the wires forming the ends of the reinforcing wire truss assembly and at least one remaining wire is shaped in an oscillating, back-and-forth arrangement between the two ends.

14. The spacing web frame assembly as recited in claim 13, wherein said reinforcing wire truss assembly includes at least three wires, two of the wires forming the ends of the reinforcing wire truss assembly and at least one remaining wire is shaped in an oscillating, back-and-forth arrangement between the two ends.

15. A method for forming a reinforced concrete wall consisting of a plurality of molded rectangular members spaced apart with a plurality of spacing web frame assemblies including a pair of inner and outer vertically-oriented wooden attachment studs and a reinforcing assembly having ends attached to the inner and outer wooden attachment studs, comprising the steps of:

forming a groove in the center of each of the wooden attachment studs, the groove having a predetermined depth and width for snugly receiving one end of the reinforcing assembly;

applying an adhesive into the groove;

inserting one end of the reinforcing assembly snugly into the groove;

installing a plurality of mechanical fasteners at predetermined points along each one of the wooden attachment studs so as to prevent the withdrawal of the end of the reinforcing assembly prior to setting of the adhesive in the groove;

placing two of said plurality of molded rectangular members between each of the spacing web frame assemblies such that the studs are contained in a combination of vertically-oriented recesses formed at outer corners of each molded rectangular member; and introducing concrete into the space between the pair of molded rectangular members.

16. The method for forming a reinforced concrete wall as recited in claim 15, further comprising the step of removing the mechanical fasteners after the adhesive has set.

17. The method for forming a reinforced concrete wall as recited in claim 15, wherein the molded rectangular members consist of foam.

18. The method for forming a reinforced concrete wall as recited in claim 15, wherein said combination of two adjoining recesses form a rectangular recess open on one side.

19. The method as recited in claim 15, wherein the reinforcing assembly comprises a reinforcing wire truss assembly.

20. The method for forming a reinforced concrete wall as recited in claim 19, wherein the reinforcing wire truss assembly includes a plurality of strands of wire.

21. A method for forming a reinforced concrete wall consisting of a plurality of molded rectangular members spaced apart with a plurality of spacing web frame assemblies including a pair of inner and outer vertically-oriented metallic attachment studs and a reinforcing assembly having ends attached to the inner and outer metallic attachment studs, comprising the steps of:

forming a channel in the center of each of the metallic attachment studs, the channel having a width greater than the diameter of an end of the reinforcing assembly;

inserting one end of the reinforcing assembly loosely into the channel;

filling the space formed between the end of the reinforcing assembly and the metallic attachment stud with a foam component such that there is no metal-to-metal contact between the end of the reinforcing assembly and the metallic attachment stud;

placing a pair of molded rectangular members between each of the spacing web frame assemblies such that the studs are contained in a combination of vertically-oriented recesses formed at outer corners of each molded rectangular member; and introducing concrete into the space between the pair of molded rectangular members.

22. The method for forming a reinforced concrete wall as recited in claim 21, wherein the molded rectangular members consists of foam.

23. The method for forming a reinforced concrete wall as recited in claim 21, wherein said combination of two adjoining recesses forms a rectangular recess open on one side.

24. The method for forming a reinforced concrete wall as recited in claim 21, wherein the channel is formed of an interior flange having a plurality of perforations so as to allow free flow of the foam component within both the channel and the interior of the metallic attachment stud to inhibit heat conduction between the reinforcing assembly and the metallic attachment stud, and to permanently attach the reinforcing assembly to the metallic attachment studs.

25. The method as recited in claim 21, wherein the reinforcing assembly comprises a reinforcing wire truss assembly.

26. The method for forming a reinforced concrete wall as recited in claim 25, wherein the reinforcing wire truss assembly includes a plurality of strands of galvanized wire.

27. A method for forming a reinforced concrete wall consisting of a plurality of molded rectangular members spaced apart with a plurality of spacing web frame assemblies including a pair of inner and outer vertically-oriented polymeric composite attachment studs and a reinforcing assembly having ends attached to the inner and outer polymeric composite attachment studs, comprising the steps of:

forming a channel in the center of each of the polymeric composite attachment studs, the channel having a width greater than the diameter of an end of the reinforcing assembly;

inserting one end of the reinforcing assembly loosely into the channel;

filling the space formed between the end of the reinforcing assembly and the polymeric composite attachment stud with a foam component, placing a pair of molded rectangular members between each of the spacing web frame assemblies such that the studs are contained in a combination of vertically-oriented recesses formed at outer corners of each molded rectangular member; and introducing concrete into the space between the pair of molded rectangular members.

28. The method for forming a concrete wall as recited in claim 27, wherein the molded rectangular members consisting of foam.

29. The method of forming a reinforced concrete wall as recited in claim 27, wherein the reinforcing assembly comprises a wire truss assembly including a plurality of strands of wire.

30. The method for forming a reinforced concrete wall as recited in claim 27, wherein said combination of two adjoining recesses forms a rectangular recess open on one side.

* * * * *